US009744544B1

(12) United States Patent
Showman et al.

(10) Patent No.: US 9,744,544 B1
(45) Date of Patent: Aug. 29, 2017

(54) PLURAL COMPONENT MIXING SYSTEM

(71) Applicant: L D J Manufacturing, Inc., Pella, IA (US)

(72) Inventors: Steve C. Showman, Pella, IA (US); Loren D. Van Wyk, Pella, IA (US)

(73) Assignee: L D J Manufacturing, Inc., Pella, IA (US)

( * ) Notice: Subject to any disclaimer, the term of this patent is extended or adjusted under 35 U.S.C. 154(b) by 0 days.

(21) Appl. No.: 14/060,559

(22) Filed: Oct. 22, 2013

Related U.S. Application Data

(63) Continuation of application No. 12/906,465, filed on Oct. 18, 2010, now Pat. No. 8,561,921.

(60) Provisional application No. 61/252,416, filed on Oct. 16, 2009.

(51) Int. Cl.
*B05B 7/12* (2006.01)

(52) U.S. Cl.
CPC ..... *B05B 7/1254* (2013.01)

(58) Field of Classification Search
CPC ..... B05B 7/0408; B05B 7/12; B05B 7/1613; B05B 7/164; B05B 7/1646; B05B 12/085; B05B 12/087; B05B 12/10; B05B 7/1254
USPC ..... 239/124, 126, 127, 135, 303–308, 407, 239/408, 412, 413, 414, 417.5
See application file for complete search history.

(56) References Cited

U.S. PATENT DOCUMENTS

| | | | | |
|---|---|---|---|---|
| 4,265,858 | A * | 5/1981 | Crum et al. | 422/129 |
| 5,810,254 | A * | 9/1998 | Kropfield | 239/61 |
| 6,505,134 | B2 * | 1/2003 | Poleshuk et al. | 702/100 |
| 7,264,178 | B1 | 9/2007 | Hugg | |
| 7,644,678 | B2 | 1/2010 | Carstens et al. | |
| 2007/0045445 | A1 | 3/2007 | Hackel et al. | |
| 2007/0218194 | A1 | 9/2007 | Carstens et al. | |

OTHER PUBLICATIONS

"Programmable logic controller", http://en.wikipedia.org/wiki/Programmable_logic_controller, [retrieved from the Internet on Oct. 11, 2010], 8 pages.

* cited by examiner

*Primary Examiner* — Christopher Kim
(74) *Attorney, Agent, or Firm* — McKee, Voorhees & Sease, PLC

(57) ABSTRACT

A plural component mixing system includes an automatic balance feature to balance the pressure of two or more components as they are mixed. The pressures or flow rates of the two components are monitored. If there is a difference in pressure or flow rate greater than a specified amount, a bleed valve is opened for a short period of time to balance the flows. A computer with a touch screen is used to set the pressure and flow rate differences that trigger the bleed, and to set the time period for the bleed.

9 Claims, 7 Drawing Sheets

PLURAL COMPONENT MIXING SYSTEM

CROSS-REFERENCE TO RELATED APPLICATIONS

This application is a continuation under 35 U.S.C. §120 of U.S. patent application Ser. No. 12/906,465, filed Oct. 18, 2010, which is a nonprovisional of provisional application Ser. No. 61/252,416 filed Oct. 16, 2009, both of which are hereby incorporated by reference in their entireties.

FIELD OF THE INVENTION

The present invention relates generally to systems for mixing liquid materials, and more particularly to systems for mixing and applying two or more liquid components to form a polyurethane based item.

BACKGROUND OF THE INVENTION

There are many situations where it is desirable to mix together two or more components to form a mixture that gets applied to form a structural component. For example, many structural items are formed from a polyurethane-based foam that is formed by mixing a urethane resin based liquid with a catalyst. When the two components mix they react to form a foam that causes the mixture to expand and eventually dry and harden into a structural element. These structural elements might include building insulation, molded foam products, and other items. In these situations it is necessary to carefully control the temperature, pressure, and flow rate of the materials being mixed.

A popular material for insulating commercial buildings and residential buildings is spray foam insulation. To create the spray foam insulation, two liquid components are mixed together as they are sprayed. As the two components mix together, they foam and expand and then relatively quickly dry and harden into a permanent insulation layer. The first liquid is commonly referred to as part A or component A and is typically comprised of isocyanates. The second component is typically referred to as part B or component B, and is typically a polymer resin. When component A and component B are mixed together at an elevated temperature, an immediate chemical reaction begins that releases gas that forms bubbles in the mixture. The mixture quickly hardens into a foamed solid.

In order to effectively apply such plural component insulations it is necessary to carefully control the temperature, pressure, and ratio of component A and component B as they are sprayed. If theses variables are not carefully controlled, it can result in an inefficient or wasteful use of the components, the resulting insulation product may be inferior, and the spraying equipment may be damaged. It can be difficult to optimally control these variables. The optimal inputs can vary during a single spraying session based on temperature changes—both environmental temperatures and equipment temperatures, especially as the equipment fully warms up. In the past, pressures have been adjusted by a user based on their observations of the quality of the foam. Electromechanical relay systems for operating check valves have been suggested for balancing the pressures of the two components as they are applied.

The efficient heating of the components to the appropriate temperature can be important. It is desirable to heat the components in a manner that is fast, and that maximizes the efficiency of the energy consumed in producing heat. In addition to heating the components, energy is required for moving the components through the system and ultimately to spray the components into place.

From the perspective of an owner of a spray rig, one of the important factors in how profitable operating the rig can be is the efficiency of the crew operating the rig. However, unless the owner is present, it can be difficult for the owner to know how efficient a crew is in their operation of the rig. For example, the efficiency could be better estimated if the owner knew how much time the crew spent spraying versus how much time was idle at a job site. Furthermore, there is danger that users of the system will "moonlight" by using the equipment at unauthorized jobs for which the owner is not being paid. Better yet would be if the owner could track the activity of the spray rig in real time from a home office.

When a mixing system, such as a spray foam insulation rig, shuts down for a long idle period between jobs, it is necessary to park the system. In particular, the pumps need to be returned to a "wet" rest position to avoid any material remaining in the pumps that could harden or crystallize and damage the pumps when they are restarted. The pressure should also be released from the system to avoid stress on the parts and to permit cleaning of the hoses and guns. Typically this is a manual process.

The components are supplied to the spray gun by a hose that includes a bundle including at least a conduit for each component. It is known to heat the conduits within the hose by using electrical resistance heaters. More recently, it has been realized that heated glycol or similar heat containing liquid can be provided to the hose to help maintain the A and B components at the proper temperature as they travel through the hose to the gun. Unfortunately, these heated hoses have been heavy and cumbersome both in storage and in use.

The present invention is an improvement over existing plural component spray rigs. It is an object of the present invention to improve the efficiency of the operation of a spray rig by automatically balancing at an appropriate ratio the pressure at which component A and component B are provided to a spray gun.

It is a further object of the present invention to efficiently heat component A and B by utilizing the heat generated by the engine and air compressor that are used to power the spray rig to provide heat to the components A and B.

It is a further object of the present invention to improve the efficiency of a spray rig by utilizing an air compressor to drive the pumps and other mechanisms used to move the components A and B through the system as well as to clear the components from the spray gun.

It is a further object of the present invention to record and log the spraying activity of the system to permit the efficiency of its use to be monitored.

It is a further object of the present invention to record and log the GPS coordinates of the spray rig as it is being used to monitor the use of the spray rig.

It is another object of the present invention to provide an automated system for returning the pump to a storage position and bleeding pressure from the system to when parking the system between jobs.

It is another object of the present invention to permit real time monitoring from a remote location of the activity of a mixing system.

It is a further object of the present invention to transfer data from the mixing system to a remote location.

It is yet another object of the present invention to permit control and reprogramming of the system from a remote location.

It is yet another object of the present invention to provide a lighter-weight heated hose for use transporting the components to the spray gun.

These and other advantages will be realized by the embodiments of the invention described and claimed herein. It should be understood that some embodiments may accomplish only one or a few of the objects. The invention should not be limited by the listed objects, except as reflected in the language of the claims.

SUMMARY OF THE INVENTION

According to one embodiment, the present invention is directed to a plural-component mixing system that includes first and second reservoirs containing first and second liquid components. A mixing apparatus is provided for mixing and applying the first and second liquid components. A supply system supplies the liquid components from the reservoirs to the spray gun. A programmable logic controller connected to the supply system controls the supply system and records information about use of the system. The system may include a touch screen interface in connection with the programmable logic controller to display information about the spraying system and to permit customized control of the spraying system. The system may include first and second bleed valves associated with the first and second liquid components respectively. First and second sensors may be included that are in communication with the programmable logic controller and that sense a quality of the liquid components. The programmable logic controller may control the first and second bleed valves based on the sensed qualities. The first and second sensors may be pressure sensors, wherein the programmable logic controller is programmed to compare the pressure at the first sensor with the pressure at the second sensor and to open the first bleed valve if the pressure at the first sensor exceeds the pressure at the second sensor by a specified amount and for opening the second bleed valve if the pressure at the second sensor exceeds the pressure at the first sensor by the specified amount. The programmable logic controller may be programmed to open the bleed valves for a specified period of time each time one of the bleed valves is opened. A user may be able to modify the specified period of time using the touch screen interface. The programmable logic controller may be programmed to automatically adjust the specified periods of time based on a determined property of the liquid components, such as the viscosity of the liquid components. The first and second sensors may be flow rate sensors, and the programmable logic controller may be programmed to open the bleed valves in response to the sensed flow rates to keep a ratio of the flow rates within a desired range. A GPS receiver may be provided in communication with the programmable logic controller to record the geographic data received from the GPS receiver when a spraying operation is initiated. The programmable logic controller may be programmed to record a time and duration of spraying operations.

According to another embodiment, the present invention is a plural-component mixing system that includes a reservoir of a first liquid component, the first liquid component being supplied to a first manifold, and a reservoir of a second liquid component, the second liquid component being supplied to a second manifold. A first pressure sensor monitors a pressure of the first liquid at the first manifold and a second pressure sensor monitors a pressure of the second liquid at the second manifold. First and second bleed valves are associated with the corresponding manifolds. A programmable logic controller compares the pressure at the first sensor with the pressure at the second sensor, and opens the first bleed valve if the pressure at the first sensor exceeds the pressure at the second sensor by a specified amount, and opens the second bleed valve if the pressure at the second sensor exceeds the pressure at the first sensor by the specified amount. The programmable logic controller may be programmed to open the first bleed valve for a first specified period of time each time the first bleed valve is opened, and the programmable logic controller may be programmed to open the second bleed valve for a second specified period of time each time the second bleed valve is opened. A user may be able to modify the specified periods of time using the touch screen interface. The programmable logic controller may be programmed to automatically adjust the specified periods of time based on a determined property of the liquid components, such as viscosity.

According to another embodiment, the invention is directed to a plural-component mixing system that includes a first reservoir containing a first liquid component and a second reservoir containing a second liquid component. A first flow-rate sensor monitors a flow rate of the first liquid and a second flow-rate sensor monitors a flow rate of the second liquid. A first bleed valve is associated with the first liquid component and a second bleed valve is associated with the second liquid component. A controller compares the flow rate at the first sensor with the flow rate at the second sensor, and opens the first bleed valve or the second bleed valve to bring a ratio of the first flow rate to the second flow rate into a desired range. A spray gun is in fluid communication with the reservoirs to spray and mix the liquid components to form a sprayed foam insulation.

According to another embodiment, the present invention is directed to a lightweight heated hose for use in applying plural component spray foam insulation. The hose includes a flexible, removable outer protective jacket. A flexible insulating jacket is contained within the protective outer jacket. First and second conduits are provided within the flexible insulating jacket. Each of the first and second conduits have an inlet for receiving a spray foam liquid component and an outlet for providing the spray foam liquid components to a spray gun. A third conduit is provided within the flexible insulating jacket. The third conduit has an inlet leg and an outlet leg. The third conduit contains a heated liquid to provide heat to the first and second spray foam liquid components in the first and second conduits. The conduits are formed from thin-walled tubing. The insulating jacket may be formed from fiberglass.

According to another embodiment, the present invention is directed to a plural-component mixing system comprising that includes first and second reservoirs containing first and second liquid components. Each of the liquid components has an associated bleed valve. A proportioner pump is provided to pressurize the liquid components. The proportioner pump has a preferred storage configuration. A programmable logic controller controls function of the bleed valves and the proportioner pump. The programmable logic controller is programmed to include a park function whereby the programmable logic controller causes the bleed valves to be opened and then causes the proportioner pump to move to the preferred storage configuration while the bleed valves remain open. Pressure sensors may associated with the liquid components to provide a signal to the programmable logic controller. The programmable logic controller may be programmed to maintain the bleed valves open during the park function until the pressure sensors indicate a sufficiently low pressure. A touch screen control may associated with the programmable logic controller to initiate the park function.

DETAILED DESCRIPTION OF THE PREFERRED EMBODIMENT

Figure 1:
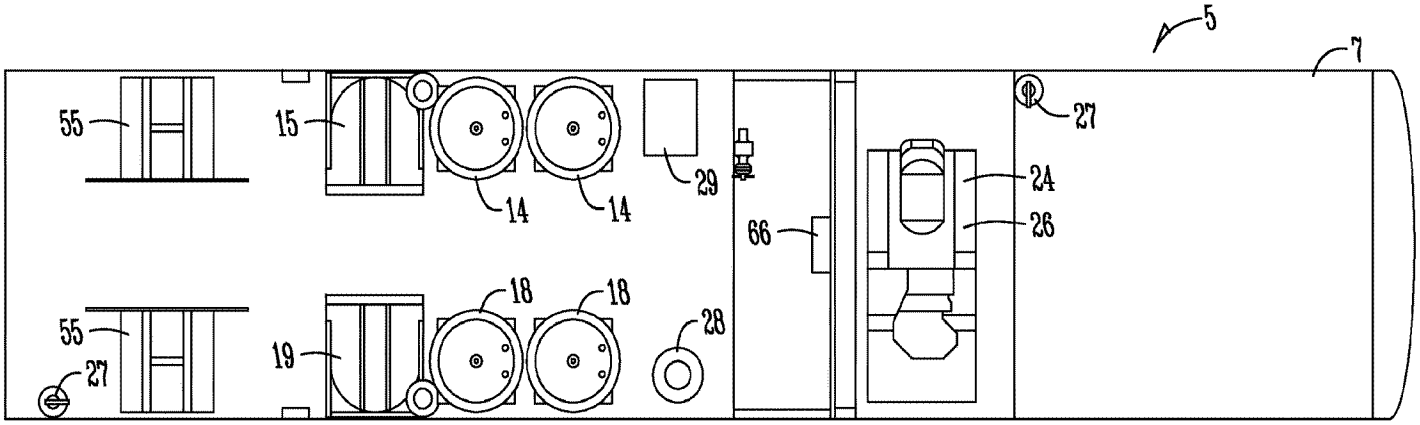
FIG. 1 is a top plan view of a rig that includes a plural component mixing system according to one embodiment of the present invention.
Figure 2:
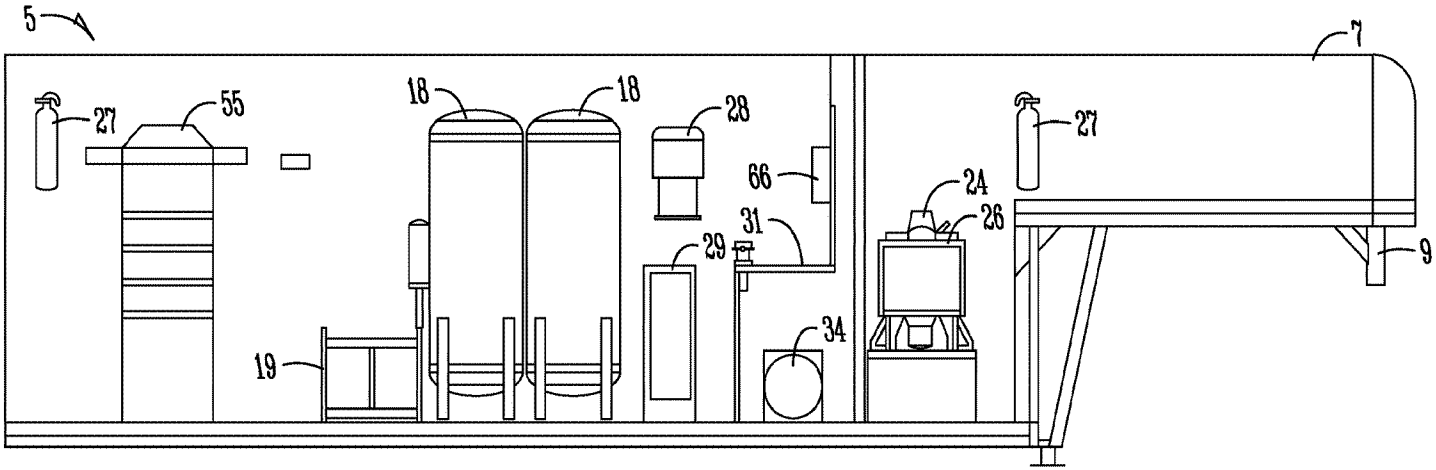
FIG. 2 is a cross-sectional view of the rig of FIG. 1.

FIGS. 1 and 2 show a spray rig 5 that includes a plural component insulation mixing system 10 according to one embodiment of the present invention. The mixing system 10 can be used to mix and apply insulation 12. The rig 5 is provided on a portable trailer 7. The trailer 7 includes a hitch 9 and wheels (not shown) that permit it to be towed by a towing vehicle (not shown) to a remote job site. As an alternative, the rig 5 could be included on a self-propelled vehicle, such as a truck. The walls of the rig 5 may be insulated. Ventilation openings and fans (not shown) may be provided to control the temperature within the trailer 7. The mixing system 10 includes a first set of permanent reservoirs 14 that are intended to contain a first liquid component A. A rack 15 is also provided for containing portable drums of the first liquid component A. In practice the rig 5 may include both the permanent reservoirs 14 and the rack 15, or may include only one or the other. Similarly, second permanent reservoirs 18 and rack 19 are provided to contain a second liquid component B. The reservoirs 14 and 18 may be large pressure vessels that will hold several drums worth of components A and B. Alternatively, in the case of a plural component mixture that contains more than two liquid components, the rig 5 could be provided with reservoirs or racks to hold additional types of components.

A liquid-cooled internal combustion engine 24 is provided to drive an air compressor 26. Preferably the engine 24 has a shaft drive connected to the air compressor 26 to drive the air compressor 26. Alternatively, a belt drive may be used. The engine 24 may for example, be a diesel engine, and the compressor 26 may be a screw compressor. According to the embodiment shown, the air compressor 26 is used to pneumatically power most of the components of the invention.

A proportioner pump 28 is driven by compressed air received from the compressor 26. The proportioner pump 28 receives liquid components A and B from the reservoirs 14 and 18 and pumps them to a heat exchanger 34. The components A and B are warmed in the heat exchanger 34 by coolant from the engine 24 and oil from the compressor 26. The heated components A and B flow rearward to hoses (not shown) provided on the hose racks 55.

A touch screen control 66 connected with a programmable logic controller (PLC) (not shown) is used to operate and monitor the system 10. The touch screen control 66 is mounted at eye level for convenient access.

The rig 5 is preferably provided with safety equipment such as fire extinguishers 27, a first aid kit (not shown) and an eye wash station (not shown). A tool cabinet 29 may also be included for storing tools. The heat exchanger 34 and other components may be hidden within a work bench 31. The work bench 31 should be easily opened to provide access to the heat exchanger 34 and other components. Those of ordinary skill in the art will recognize many configurations for the various components within the rig 5.

Figure 3:
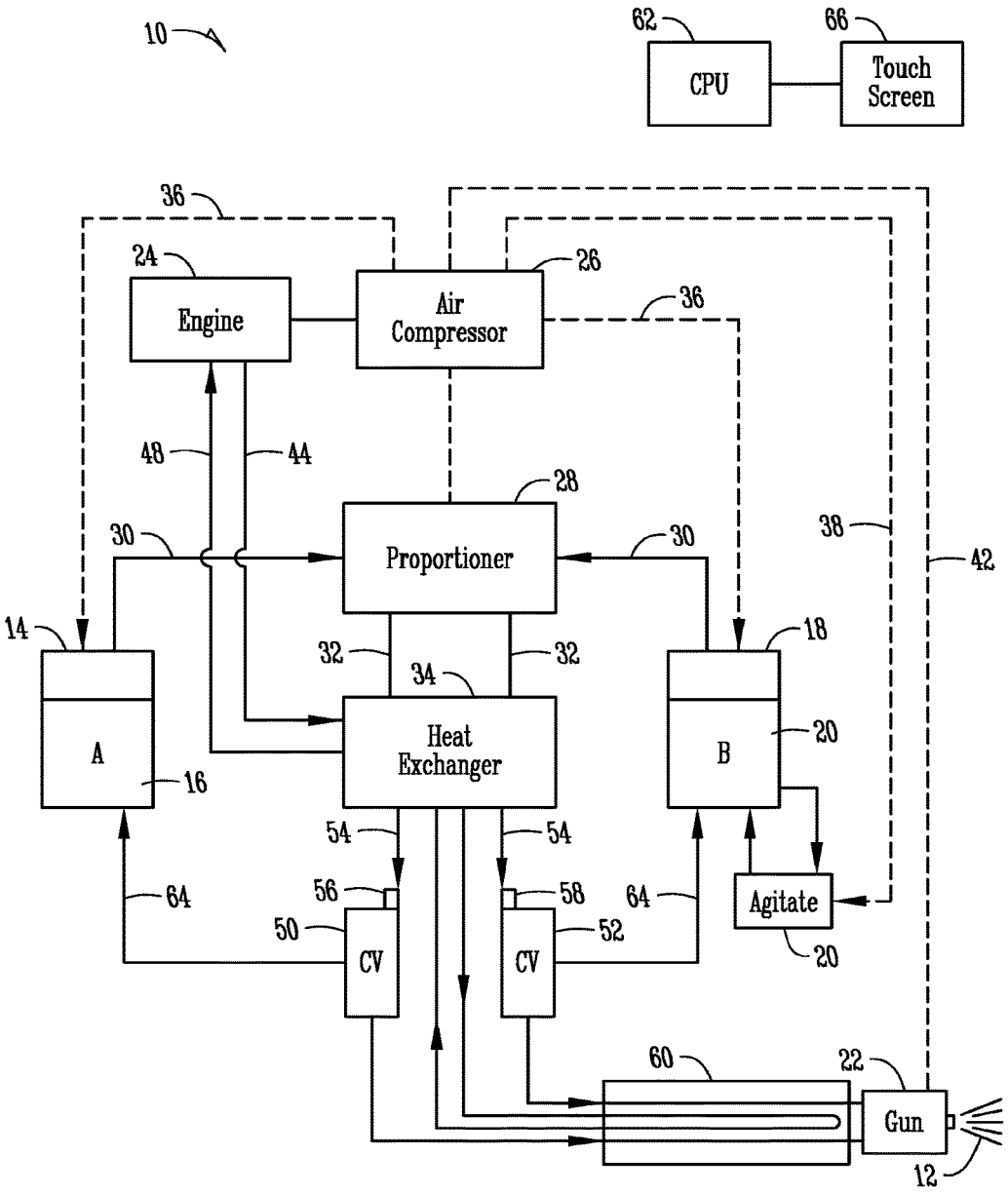
FIG. 3 is a schematic illustration of a plural component mixing system according to one embodiment of the present invention.

FIG. 3 is a diagram that illustrates the primary components of the mixing system 10 that can be used to mix and apply insulation 12, according to one embodiment of the present invention. The mixing system 10 includes a first reservoir 14 that contains component A 16, which typically will be an isocyanate liquid. A second reservoir 18 contains component B 20, which will typically be a polymer resin. The reservoirs 14, 18 may be the 55-gallon drums in which components A and B are typically transported, or may be larger storage tanks which can hold a larger supply of the components. Additionally, and as will be discussed below, more than one reservoir may be used for storing each component in order to increase the volume of components that can be carried efficiently. A mixing apparatus, such as a spray gun 22 is provided as part of the system 10 in order to apply the insulation 12. The gun 22 has a trigger (not shown) that allows a user to selectively spray components A and B such that they mix together to form the insulation 12. The mixing system 10 provides an effective and efficient apparatus for moving the components A and B from the reservoirs 14 and 18 to the gun 22. As an alternative to a spray gun, a mixing apparatus might include a variety of applicators or other mixing devices.

A liquid-cooled internal combustion engine 24 is provided to drive an air compressor 26. Preferably the engine 24 has a shaft drive connected to the air compressor 26 to drive the air compressor. Alternatively, a belt drive may be used.

The air compressor 26 provides compressed air to various components in order to control and drive the components. A proportioner pump 28 is driven by the compressed air received from air compressor 26. The proportioner pump 28 receives a low pressure supply of components A and B through inlet pipes 30. The proportioner pump 28 pressurizes the components A and B and pumps them to heat exchanger 34 through outlet pipes 32. Preferably the proportioner pump 28 will pressurize the components A and B to a pressure of about 1300 to 1400 pounds per square inch. The components A and B remain separate from each other within the proportioner pump 28 and the outlet pipes 32. Preferably, the proportioner pump 28 will pump components A and B through the outlet pipes 32 at a ratio of about 1:1 on a by-volume basis. Alternatively, it may be possible to match the ratios of the components A and B to some other desired ratio. For example, it may be desirable to pump the components A and B on a 1:1 basis by weight rather than volume. It may also be possible to pump the components at a different specified ratio that works better for a given set of components. Furthermore, additional reservoirs with different liquid components could be added such that more than two components are kept in balance during a mixing and/or applying operation.

The air compressor 26 also provides pressurized air to the reservoirs 14 and 18 through pneumatic lines 36. The pressurized air provided through pneumatic lines 36 is used to pump the components A and B through the inlet pipes 30 to the proportioner pump 28. The air compressor 26 is also attached to a pneumatic line 38 that provides pressurized air to an agitator pump 40. The agitator pump 40 is used to agitate and mix the resin 20 that makes up component B. The agitator pump 40 serves to recirculate component B 20 within the reservoir 18 to keep component B 20 in appropriate condition for mixing with component A to form the insulation. It should be appreciated that while the pneumatic lines, shown in broken lines within FIG. 3, are illustrated as direct connections between the air compressor 26 and the various components, in practice the pneumatic lines would run through a manifold or manifolds that can selectively turn on and shut off the supply of pressurized air from the air compressor 26 to the various components. Additionally, while not shown in FIG. 3, the pressurized air from air compressor 26 may be used to control several valves that control the flow of components A and B through the system 10. The air compressor 26 supplies pressurized air to the gun 22 through pneumatic line 42. This pressurized air is used to clear the liquid components from the gun 22 so that they do not foul or clog the gun 22. Therefore, when the trigger is depressed to spray the insulation 12, the air flow from the air compressor 26 may be shut off, and the pressure of the components A and B may be relied upon to discharge the spray of insulation. When the trigger of the gun 22 is released, pressurized air blows through the gun 22 to clear the spray tip of any remaining component A and B in order to keep the gun 22 clean.

The engine 24 is cooled with an engine coolant, such as glycol. A coolant line 44 is used to supply coolant from the engine 24 into the heat exchanger 34. The coolant remains in a closed loop, and passes through the heat exchanger 34 and then through a loop 46 that extends from the heat exchanger 34 to the gun 22 and then back to the heat exchanger 34. The coolant then flows back from the heat exchanger 34 to the engine 24 through return line 48. A pump (not shown in FIG. 3) may be provided within the coolant loop to help circulate the coolant from the engine through the heat exchanger to the gun 22 and back through the heat exchanger 34 to the engine 24. Also, while not shown in FIG. 3, the air compressor 26 may have a loop of air compressor oil that circulates through the heat exchanger 34 to cool the air compressor 26 and heat the components A and B.

The components A and B are provided to the proportioner 28 at a relatively low pressure through inlet pipes 30. The proportioner 28 pressurizes the components A and B and provides them to the heat exchanger 34 through outlet pipes 32. Within the heat exchanger 34 heat is transferred from the engine coolant to the components A and B to heat the components A and B to a desired temperature. The components A and B then flow out of the heat exchanger 34 through heat exchanger outlets 54 which lead to bleed valves 50 and 52. The bleed valves 50 and 52 could be cartridge valves or other types of valves. In operation the components A and B pass through the bleed valves 50 and 52 to insulated hose 60 that leads to gun 22. Pressure sensors 56 and 58 measure the pressure of components A and B respectively at the bleed valves 50 and 52. Pressure sensors 56 and 58 are connected either through wires, or by a wireless router, with computer 62. The bleed valves 50 and 52 can be used to bleed off excess pressure from the components A and B to keep the pressures in balance. The bleed valves 50 and 52 have bleed lines 64 that lead back to the reservoirs 14 and 18. If the pressure difference sensed by sensors 56 and 58 is too great, the control valve 50 or 52 that is associated with the higher pressure will be opened for a short period of time to bleed off pressure so that the pressures in the two lines are brought into balance.

The specified ratios are typically provided on a by-weight or by-volume basis. Therefore, pressure is only an indirect mechanism for determining the desired ratio. As an alternative, the sensors 56 and 58 may be flow rate sensors that measure the actual rate of flow of components A and B through the system. This may provide a more accurate mechanism for assuring the appropriate ratio of the components A and B than pressure. Therefore, a specified ratio of flow rates may be maintained by using the bleed valves 50 and 52. If the ratio of flow rate of component A as measured at sensor 56 compared to the flow rate of component B measured at sensor 58 is too great (e.g., exceed 1.01) then bleed valve 50 can be opened for a specified period of time to bleed pressure from that line and reduce the flow rate of component A. Similarly, if the ratio of the flow rate of component A to the flow rate of component B is too small (e.g., less than 0.99), the bleed valve 52 can be opened for specified period of time to reduce the pressure in that line and hence reduce the flow rate of component B.

A touch screen 66 may be associated with the computer 62 to display information about the system 10, and to permit a user to provide inputs to the computer 62. Preferably the computer 62 will be a programmable logic controller (PLC). A user may specify how great the pressure difference sensed by sensors 56 and 58 must be before one of the control valves 50 or 52 is opened to bleed off pressure. Additionally, the touch screen 66 may be used to input a duration that the bleed valves 50 or 52 will be opened in response to a sensed pressure difference that is sufficient to trigger opening one of the valves 50 or 52. For example, a user might input that a pressure difference of greater than 100 psi will trigger the higher pressure side to open its valve 50 or 52. The user may also specify the time that the valve 50 or 52 will remain open, for example $1/10^{th}$ of a second. It is critical that the pressure of the components A and B not be too far apart when they are combined together in the gun 22 as they are sprayed. If the pressure difference is too great, it can cause back flow from the higher pressure component into the outlet for the lower pressure component, which can result in foaming and expansion of the materials inside the system. That can lead to catastrophic failure. Therefore, the bleed valves 50 and 52, in conjunction with the pressure sensors 56 and 58 and the computer 62 are used to maintain the system in appropriate balance.

Similarly, if the sensors 56 and 58 are flow rate sensors, a user may use the touch screen 66 to specify a desired range for the ratio of the flow rate of component A to component B. For example the range could be from 0.99 to 1.01. If the ratio is outside this range, the bleed valve 50 or 52 associated with the component with too high of a flow rate can be opened for a period of time that can also be specified by the user—for example, 0.1 seconds. If use of the system shows that frequent repeated bleed operations are occurring, a user can specify longer time period (e.g., 0.2 seconds) for the valve 50 or 52 to be opened on each occurrence. Or, if each bleed operation results in to great of a drop in pressure, a short time can be specified (e.g., 0.05 seconds). This also provides a convenient mechanism for dealing with different products, which might have a different specified ratio. Furthermore, both pressure sensors and flow rate meters could be used simultaneously. In the instance where both flow meters and pressure sensors are used in the balancing process, the flow rate would be the primary control variable for determining when to open a bleed valve. The reading from the pressure sensors would be for detecting errors in the system. For example if the pressure difference between the two fluids is greater than expected, it could be flow is impeded in one of the lines. Therefore a warning could be generated on the touch screen, or in severe cases, the PLC could cause the system to shut down entirely, so that the source of the problem can be identified and fixed.

Figure 4:
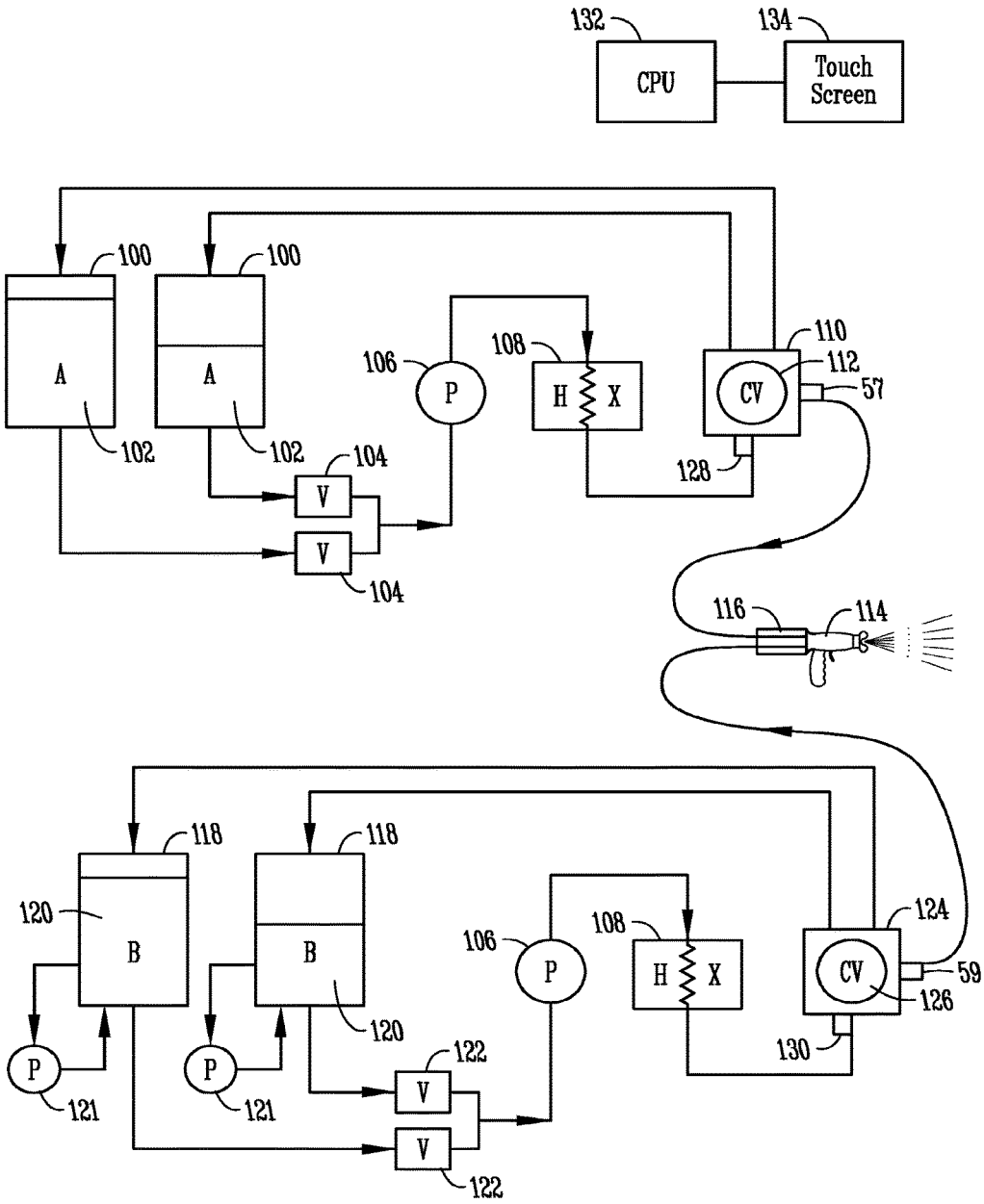
FIG. 4 is a schematic diagram illustrating the flow of components A and B through a plural component mixing system according to one embodiment of the present invention.

The flow of components A and B through the system may be better understood by reference to FIG. 4. As seen in the component flow diagram of FIG. 4, the system may be provided with two or more reservoirs 100 for storing component A 102. The reservoirs 100 are each connected to a corresponding valve 104 that can be selectively opened or closed. Opening the valves 104 permits flow of component A 102 to the proportioner pump 106. In practice, typically one of the valves 104 will be opened and one closed so that only a single reservoir 100 is being used at any one time. The valves 104 may be manually opened and closed, or may be controlled electronically, for example through a computer 132. Component A 102 will be supplied to the proportioner 106 through valves 104 at a relatively low pressure, typically around 150 psi. The proportioner 106 will pressurize the component A 102 to about 1000 to 3000 psi. The pressurized component A 102 flows from the proportioner 106 through heat exchanger 108 where the component A 102 is heated to a desired temperature range for mixing with component B and spraying. The heated component A 102 flows from the heat exchanger to manifold 110 that includes a bleed valve 112. The bleed valve 112 can be selectively opened to bleed off excess pressure. In practice, the bleed valve 112 may be two or more valves. When the valves are opened, they have lines that lead back to the reservoirs 100 so that as pressure and excess material are bled off, the excess component 102 is returned to the reservoirs 100. The component A 102 flows from the manifold 110 to spray gun 114 through insulated hose 116.

Reservoirs 118, which may include two or more reservoirs 118, contain resin component B 120. Each of the reservoirs 118 has an associated agitator pump 121 which is used to circulate and agitate component B 120 so that component B 120 is ready for use. Valves 122, which may be provided separately or as part of a single manifold, are used to selectively provide a flow of component B 120 from the reservoirs 118 to the proportioner pump 106. Typically, only one of the valves 122 will be opened at any one time. Preferably, the proportioner pump 106 will be the same proportioner 106 as is used to pressurize component A 102. The pressurized component B 120 flows from the proportioner 106 through heat exchanger 108 which preferably will be the same heat exchanger 108 that is used to heat component A 102. The component B 120 flows from the heat exchanger 108 to manifold 124 that includes one or more bleed valves 126. If the bleed valves are opened they will bleed off excess pressure from the component B 120. When the bleed valve 126 is opened, the excess component B 120 that bleeds off is returned to one of the reservoirs 118 so that the material is not wasted. The bulk of the component B 120 flows through the manifold 124 to the gun 114 through insulated hose 116 where it can be sprayed and mixed with component A 102 to form the foam insulation.

The pressures of component A 102 and component B 120 are sensed by pressure sensors 128 and 130 respectively that are located at or within the manifolds 110 and 124. The pressure sensors 128 and 130 are in communication with central processing unit 132. Therefore, the pressures of the component A 102 and the component B 120 are continuously provided to the CPU 132 by the sensors 128 and 130. The CPU 132 is programmed to compare the pressures within component A 102 and component B 120 at the manifolds 110 and 124. The CPU 132 is also connected with bleed valves 112 and 126, either directly or through a control mechanism, such that the CPU 132 can selectively open the bleed valves 112 and 126. A user may input a pressure differential between component A and component B that will cause the CPU 132 to open the bleed valve 112 or 126 that is associated with the higher pressure component. A touch screen 134 or other input device such as a keyboard, may be used to input the triggering pressure differential. In addition, the time duration for which the bleed valve 112 or 126 will be opened upon each triggering event may be input by a user. Each of the bleed valves 112 and 126 may be set to be open for the same duration, or they may have different durations. In general, if the components have a relatively high viscosity, a relatively longer time period should be selected to open the bleed valves, and conversely when the components have a low viscosity, for example at elevated temperatures, a relatively shorter time period may be used for opening the bleed valves 112 and 126.

While not shown in FIG. 4, the reservoirs 100 and 118 may be provided with sensors for measuring the remaining amount of component within the reservoirs 100 and 118. For example, proximity sensors may be provided at the top of the reservoirs 100 and 118 to determine the distance between the top of the reservoirs 118 and 100 and the top of the fluid level of the component within the reservoir. The sensors may be connected with the CPU 132 and an output may be displayed on touch screen 134 to permit a user to monitor the amount of material remaining to be sprayed. Additionally, temperature sensors (not shown in FIG. 4) may also be provided at various locations to monitor the temperature of the components 102 and 120. These temperatures may be communicated to the CPU 132, which in turn may display that information on the touch screen 134 so a user can monitor the temperatures. Additionally, the CPU 132 may be programmed to control the flow of coolant to the heat exchanger 108 to regulate the temperature of the components 102 and 120 as desired.

These components may also be used to perform an improved "parking" function when the system is being shut down for an extended idle period, for example at the end of the work day, or when finishing at a work site. In order to prevent damage to the proportioner 106, it is desirable to park the proportioner in its storage position. Typically this storage position will be one where the pump is at the end of stroke such that the seal remains wet and not excess component remains in the cylinder. If the proportioner 106 is adjusted to this park position it can over pressurize the component in the lines down stream from the proportioner, unless the bleed valves 112 and 126 are opened. Therefore, the present invention has a park feature programmed into the CPU (PLC) 132. A user selects the park function using the touch screen 134. The CPU 132 will then cause the bleed valves 112 and 126 to remain open while the proportioner 106 strokes to its storage position. The bleed valves 112 and 126 will remain open until the pressure sensors 128 and 130 sense that the pressure is at, or nearly at, zero. An indication may be given by the touch screen 134 that the parking function has been completed, and that it is safe to remove the hose 116 and gun 114 for cleaning.

Figure 5:
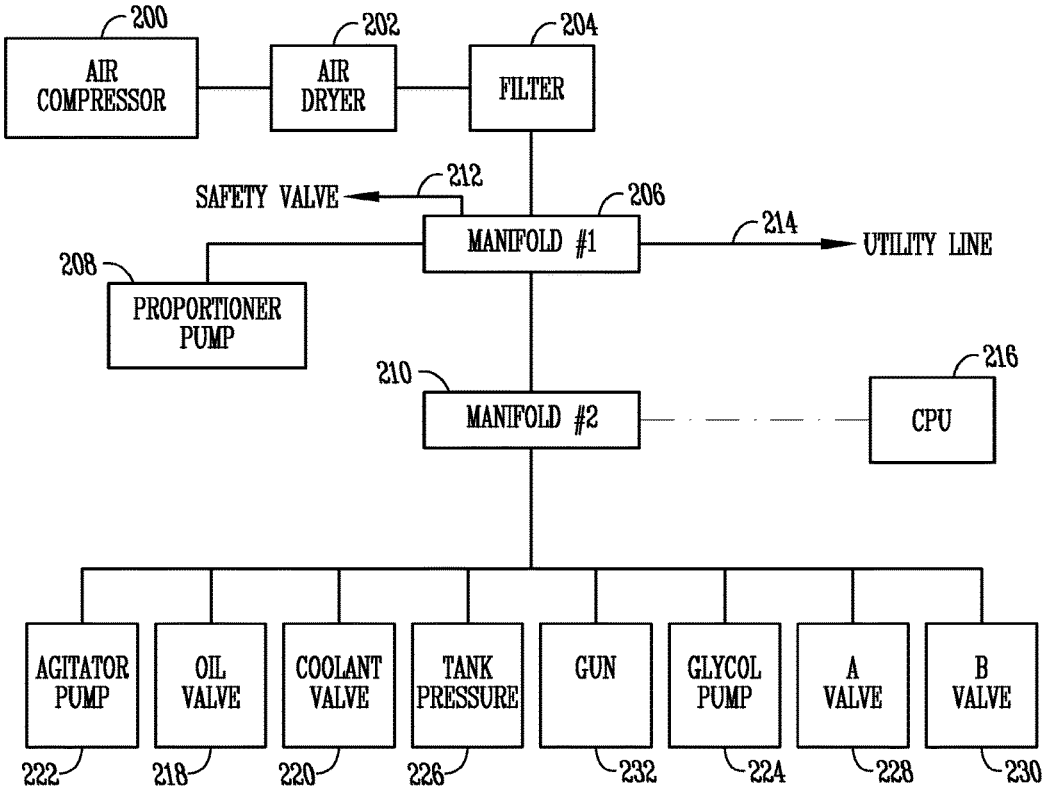
FIG. 5 is a schematic representation of the pneumatic components according to one embodiment of the present invention.

FIG. 5 is a schematic illustrating the pneumatic components of the mixing system 10 isolated from the other components for ease of visualization. Pressurized air is provided to the pneumatic components by an air compressor 200. Preferably the air compressor 200 is directly driven by a shaft of an engine (not shown in FIG. 5). The air from the air compressor 200 should be treated to remove moisture and contaminants, for example, by a dehumidifier 202 and a filter 204. Those of ordinary skill in the art will be aware of appropriate devices and methods for conditioning the air before providing it to the various pneumatic components. The conditioned air may be provided to a first manifold 206. The first manifold 206 has outlets that provide the pressurized air first to a proportioner pump 208 and also to a second manifold 210. The first manifold 206 may be provided with a safety valve to prevent the system from overloading the pneumatic components. Additionally, the first manifold 206 may be provided with utility outlets 214 such that a user can attach additional pneumatic components to the system as desired.

The second manifold 210 may be in communication with a computer 216 that can control various valves within the manifold 210. The manifold 210 serves to control and selectively provide pressurized air to the various pneumatic components. For example, the second manifold 210 may selectively open and close a valve 218 that controls the flow of oil from the air compressor 200 to the heat exchanger (not shown in FIG. 5). Similarly, the second manifold 210 can be used to selectively provide pressurized air to coolant valve 220 that controls the flow of engine coolant to the heat exchanger (not shown in FIG. 5). By controlling valves 218 and 220, through the manifold 210, the CPU 216 can control the temperature of the components A and B. The pressurized air from the second manifold 210 can also be provided to the agitator pumps 222 that agitate the component B. The pressurized air from manifold 210 can also be supplied to a diaphragm pump 214 that is used to circulate the engine coolant.

The pressurized air from the second manifold 210 is also used to control the flow of components A and B to the proportioner pump 208. This is accomplished by providing a supply of the air from the manifold 210 to the top of the reservoirs (not shown in FIG. 5). Pressurizing the reservoir tanks with the pressurized air in turn pressurizes the components A and B with the reservoir tanks encouraging the contents to flow to the proportioner pump 208. In addition, the valves 228 and 230 that control the flow from the reservoir tanks 226 to the proportioner pump 208 are selectively actuated by pressurized air provided by the second manifold 210 as controlled by the computer 216. Pressurized air is also provided to the gun 232 through the second manifold 210. This pressurized air is used to blow out any excess liquid components remaining in the nozzle of the gun 232 after spraying the components.

Figure 6:
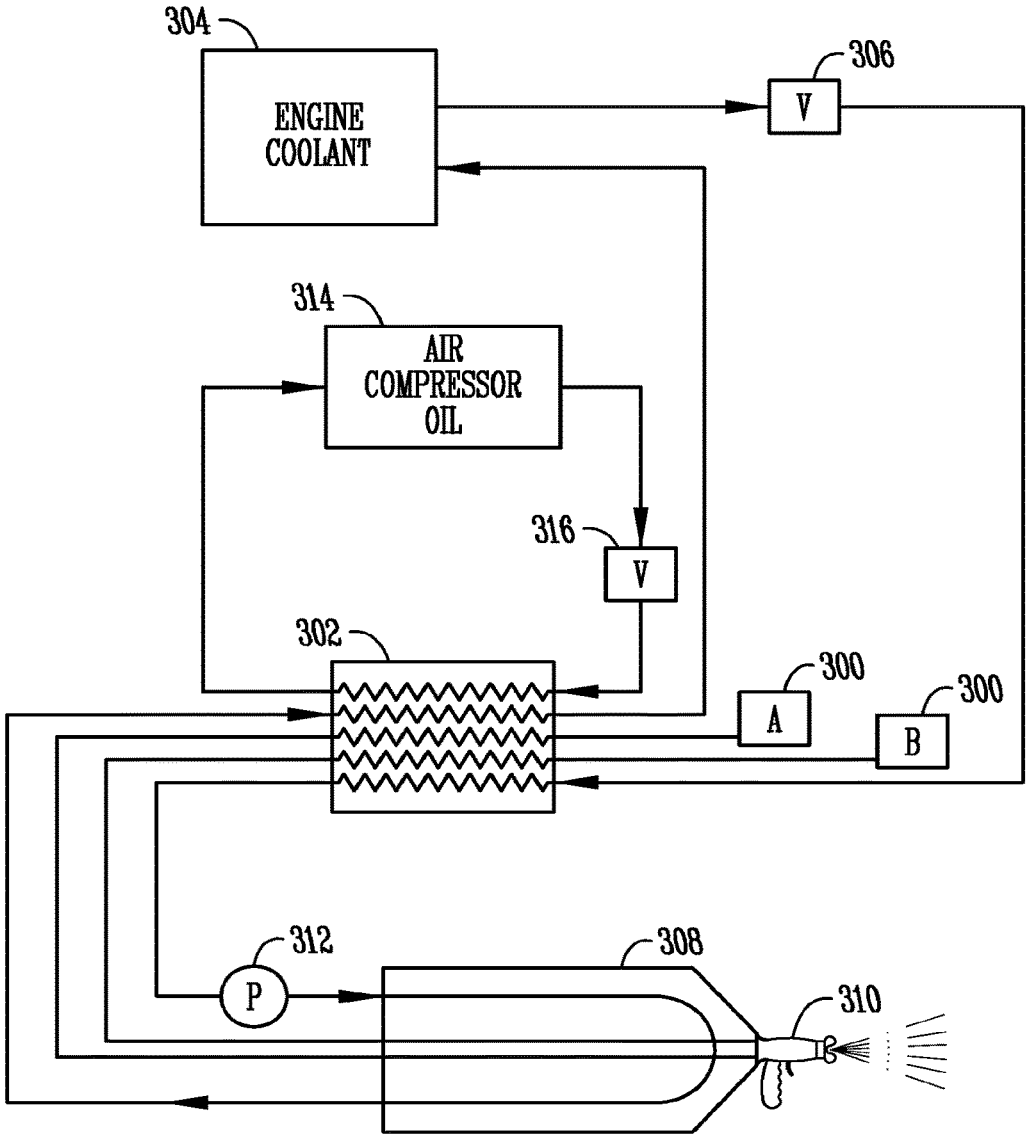
FIG. 6 is a schematic representation illustrating the mechanism for heating the components according to one embodiment of the present invention.

FIG. 6 is a diagram illustrating the elements of the system that are used to heat the components A and B isolated from the other elements of the system for ease of visualization. As seen in FIG. 6, components A and B are separately stored in storage tanks 300 and flow through heat exchanger 302 in separate conduits. While passing through the heat exchanger 302, the components A and B are heated by engine coolant and air compressor oil that both also flow through the heat exchanger 302. The engine coolant, typically glycol, is circulated through the heat exchanger 302. The engine coolant travels from the engine 304 through a ball valve 306 that can be selectively opened or closed to help control the final temperature of the components A and B. After flowing through the heat exchanger 302, the glycol engine coolant makes a loop through the insulated hose 308 in order to maintain the temperature of components A and B as they flow through the hose 308 to the gun 310. The glycol coolant then flows back to the heat exchanger 302 on its return leg to the engine 304, so that additional heat may be extracted from the coolant and passed onto the components A and B. A pump 312 may be included in the engine coolant loop to circulate the engine coolant. In the embodiments shown in FIG. 6, the pump 312 is located in a preferred location downstream from the heat exchanger 302 and upstream from the hose 308.

Oil from the air compressor 314 also flows through heat exchanger 302 in a circulating loop. A valve 316 is provided to selectively control the flow of air compressor oil through the loop. Therefore, the system efficiently uses heat generated to operate the elements of the system to heat the components A and B.

Figure 7:
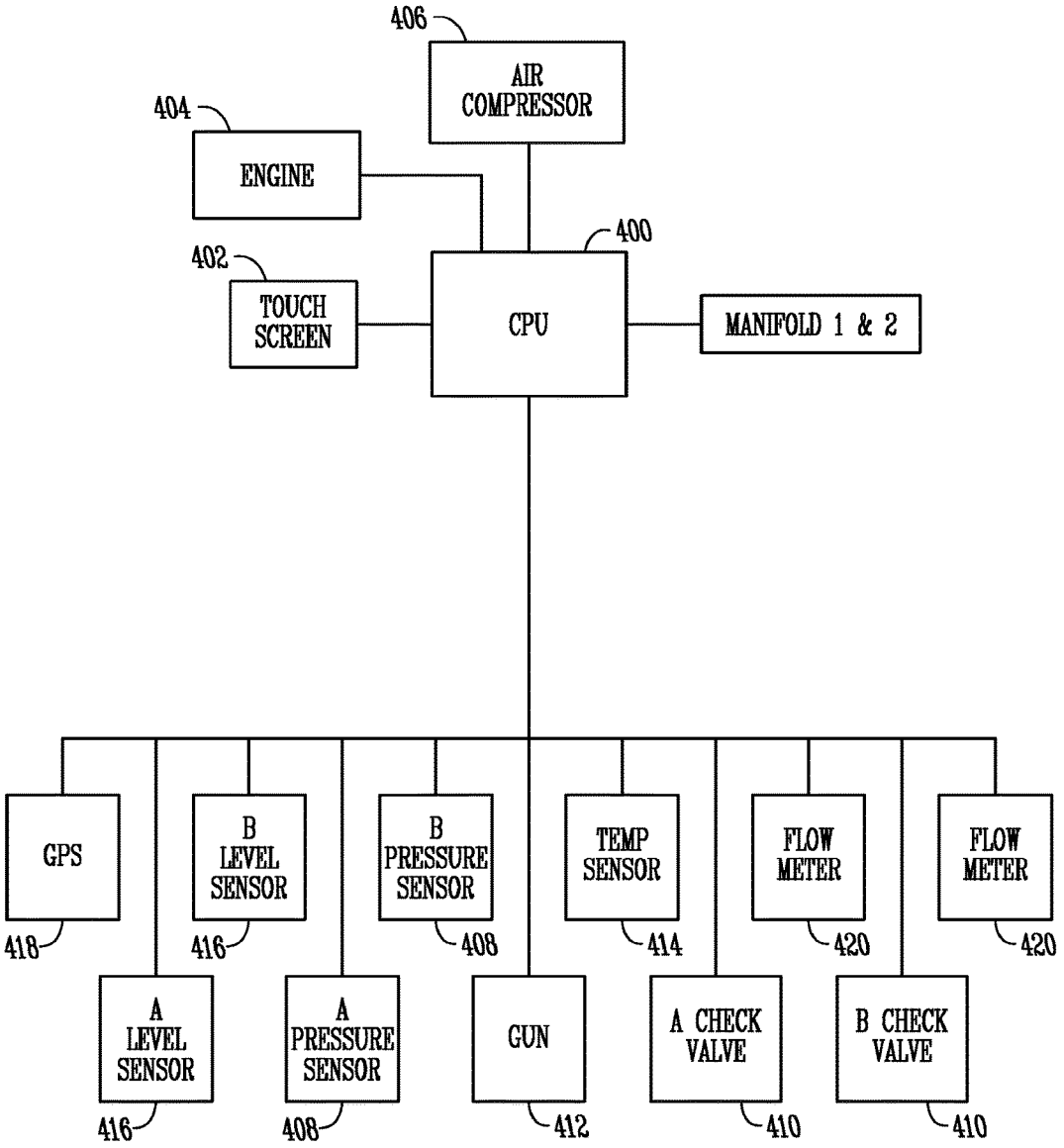
FIG. 7 is a schematic illustration of the control mechanism for the plural component mixing system according to one embodiment of the present invention.

FIG. 7 is a schematic diagram illustrating the control and monitoring features according to one embodiment of the present invention. A computer central processing unit (CPU) 400 is provided to receive and log information from sensors provided as part of the system. Preferably the CPU 400 will be part of a programmable logic controller (PLC). The CPU 400 is also programmed to automatically control many of the elements of the system. A touch screen 402 is operationally connected with the CPU 400 to display output from the CPU 400 and permit a user to input data and responses into the CPU 400. As an alternative, a display screen with a separate key board and monitor may be used to perform the functions of touch screen 402. A communications device 409, such as a wireless modem or cellular phone may be associated with the CPU 400, such that a user can send and receive data from the CPU 400.

The engine 404 has sensors connected with the CPU 400 so that the CPU 400 can monitor and log the time the engine 404 has been running, the engine temperature, the oil pressure, the voltage of the battery for the engine, fuel level of the engine, and the RPM rate. The air compressor 406 is connected to the CPU 400 so that the CPU 400 can monitor and log the air compressor's temperature and air pressure.

Various other sensors throughout the system also provide input that is monitored and logged by the CPU 400. Most fundamentally, pressure sensors 408 provide an input of the pressures for components A and B. As described above, if there is a significant difference in pressures between components A and B, as measured by sensors 408, the CPU 400 will send a signal that causes one of the bleed valves 410 to open for a short period of time to bleed pressure off of the higher pressure component. The touch screen 402 permits a user to specify how much of a pressure difference is required to trigger such a pressure bleeding event or what deviation from a desired flow rate ratio will trigger a bleeding event. The user may also specify through the touch screen 402 a period of time that the bleed valve 410 will be opened upon sensing a sufficiently large pressure difference to trigger the pressure bleeding event. The CPU 400 may also be connected with the gun 412 to monitor and log the spraying activity. This log information of spraying activity can be useful for comparing how efficiently an operator is using the system. The log information may be provided to a remote location, such as a home office, in real time, or nearly real time, via the communication device 409. Therefore, a manager located in a home office can monitor the work being performed by a rig, or several rigs, without having to travel to the location of the rigs. The log information gathered by the system that can shared with the remote manager would include mixing time and idle time, the amount of material used, and the geographic location of the rig. The manager can address any difficulties immediately, rather than waiting for end of the day reports. Furthermore, the log information may be directly and automatically entered into a billing system to automatically generate a bill based on the time, location, and amount of material used.

Various temperature sensors 414 may also be connected with the CPU 400. The temperature sensors 414 can provide information to the CPU 400 about the temperature of the components A and B so that the CPU 400 may control the flow of coolant and compressor oil into the heat exchanger to maintain a proper temperature. If the system cannot maintain the an appropriate pressure ratio or if the temperature of the components A or B reach an unsafe level, the controller can be programmed to automatically shut down the system to prevent damage. An error message will be displayed on the touch screen 64 indicating the reason for the shut down. A user can specify what pressure ratio and temperatures will trigger an automatic shut down. Furthermore, the CPU may be programmed to recognize when too many or too frequent bleed events are being required which indicates a problem somewhere in the system. A warning can be generated, or the system may automatically shut down. This can permit a user to solve a problem before damaging the equipment, or spraying faulty insulation that will need to be replaced at significant expense.

Additionally, an air temperature sensor (not shown) may be connected with the CPU 400 so that if the engine room temperature is too high, the system can automatically shut down to prevent damage or injury.

Proximity sensors may be provided on the component A and component B storage tanks to measure the level of liquid within the storage tanks. These proximity sensors 416 may be connected with the CPU 400 so that the amount of materials remaining can be monitored and displayed on the touch screen 402.

A GPS receiver unit 418 may also be provided as part of the plural component spraying system. This GPS unit 418 may be connected to the CPU 400 so that the spraying data may also be associated with a particular geographic location. In addition, or in the alternative, the GPS unit 418 may provide information back to a home base or remote location, so that the location of the unit may be monitored at all times. This can be important information to ensure that the mixing system is being used in the most efficient manner, and is not being used in any unauthorized locations.

The communications device 409 may permit the CPU 400 to be reprogrammed from a remote location, such as a home office. Therefore, if the parameters or characteristics of one of the components change, for example if a new vendor is being utilized, the operational features of the system could be revised to match the new parameters. This could be especially useful for updating an entire fleet of rigs quickly. For example, if a new component B is being utilized that has a higher viscosity that the previously used component B, the system could be modified to open the bleed valves for a longer period of time each time they are opened. This could be done from the home office on all rigs in the fleet without the need for the manager to go to the rigs or have the rigs come to the home office.

Figure 8:
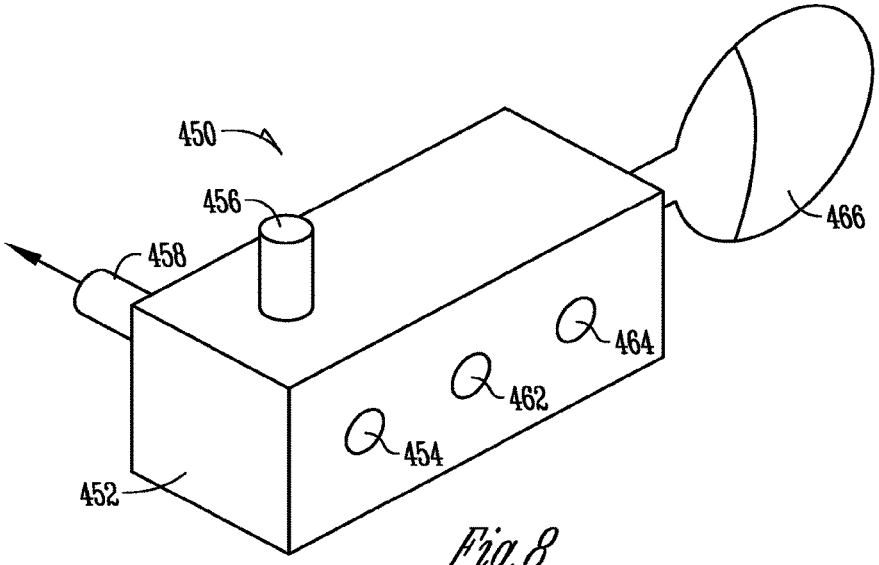
FIG. 8 is an isometric view of a bleed valve manifold according to one embodiment of the present invention.
Figure 9:
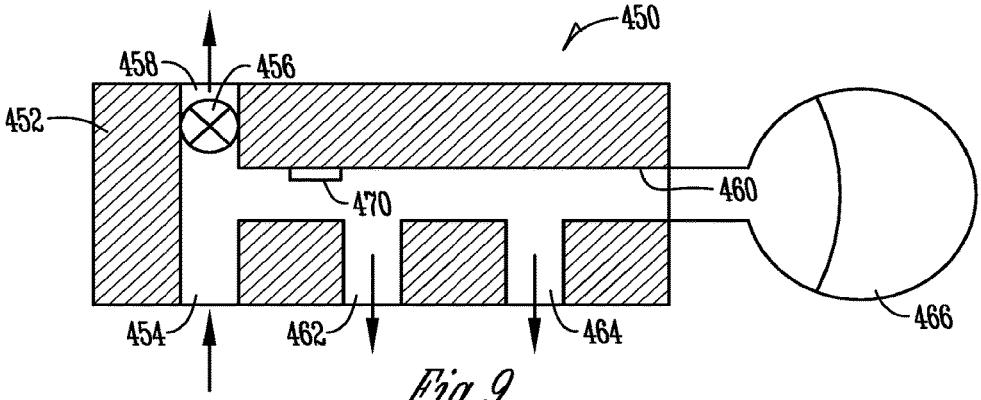
FIG. 9 is a cross-sectional view of the bleed valve manifold of FIG. 8.

FIGS. 8 and 9 illustrate a manifold 450 that is used to automatically balance the pressure between components A and B according to one embodiment of the present invention. The manifold 450 includes a solid body 452 that includes an inlet passage 454 for receiving a compressurized component A or component B. A bleed valve 456 is provided in the inlet passage 454. The bleed valve 456 is adjustable to either prevent or permit flow of the pressurized component through an outlet bleed line 458. The inlet passage 454 is connected with a central passage 460 (only visible in cross-section view 7). The central passage 460 connects with two outlet passages 462 and 464. Each of these outlet passages 462 and 464 may be connected to its own mixing apparatus (e.g., spray gun) (not shown in FIG. 6 or 7). Accordingly two spray guns may be utilized off of the same manifold 450. The central passage 460 also leads to an accumulator 466 that serves to moderate and maintain a constant pressure within the central passage 460 and outlet passages 462 and 464.

A pressure sensor 470 is provided in the central passageway of the manifold 450 to monitor the pressure of the component A or B as it is provided to the manifold 450. The bleed valve 456 is automatically controlled by a computer that compares the pressures of the component A or B provided to the manifold with a similar pressure of the other component A and B that is provided to a similar manifold. If the pressure of the component provided to manifold 450 exceeds by more than a specified amount the pressure of the component provided to another similar manifold, then bleed valve 456 is opened to permit the component to flow out the bleed line 458 for a short period of time to reduce the pressure in the system. Typically, opening the valve 456 for a tenth of a second or less will be sufficient to reduce the pressure within the central passage 460 by 100 psi or more. It should be understood that the manifold 450 shown in FIGS. 8 and 9 is for a system that includes mixing apparatuses (e.g., two spray guns) and one supply tank. Those of skill in the art will recognize that several various numbers of orifices may be provided to the central passage depending upon how many mixing apparatuses and supply tanks are being utilized. It may be preferable to make a standardized manifold 450 with a large number of orifices that can be selectively plugged, for example by a threaded cap, if not needed.

Figure 10:
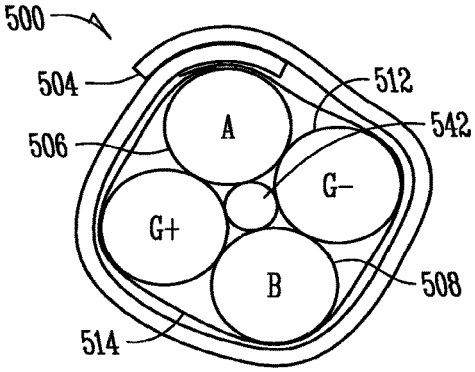
FIG. 10 shows a cross-sectional view of a hose according to a preferred embodiment of the present invention.

FIG. 10 shows a cross-sectional view of a hose 500 according to a preferred embodiment of the present invention. The hose 500 has an insulated outer jacket 502 that should be flexible and durable and may be formed from a variety of materials, such as nylon, Gore-Tex, or other similar fabric. In a preferred embodiment, the outer jacket 502 has a hook and loop fastener (e.g., Velcro) seam 504 that can be selectively opened and closed to insert the hose components. The hose 500 includes within it conduit lines 506 and 508 that carry component A and B respectively to the gun. In order to help maintain components A and B within the conduits 506 and 508 at the desired temperature, a loop of glycol coolant is also provided within the hose 500. The loop of glycol coolant includes in cross-sectional view a first conduit 510 that carries engine coolant that is flowing in the same direction as the components A and B within conduits 506 and 508. In cross-section, a second glycol conduit 512 is the return leg of the glycol loop that contains glycol flowing the opposite direction as the components A and B in conduits 506 and 508. An air conduit 542 for providing pressurized air to an attached mixing device, such as a spray gun, is also provided within the bundle. The conduits 506, 508 that carry the pressurized components A and B may be formed from Teflon and woven stainless steel. Preferably the conduits 506 and 508 will have an inner diameter of about 0.375 inches. The glycol conduit 510 and 512 is a thin-walled PVC tubing having an inner diameter of about 0.375 inches and an outer diameter of about 0.5 inches. The air conduit 42 may also be formed from thin-walled PVC tubing having an inner diameter for about 0.25 inches. These thin-walled PVC tubes are a significant improvement over prior art designs that utilized rubber or other thicker-walled tubes. They result in a smaller diameter, lighter hose for easier storage and manipulation. Conduits 506, 508, 510, 512, and 542 are all tightly bundled together and wrapped by a fiberglass insulating jacket 514. The fiberglass insulating jacket 514 should be flexible to permit the hose to be easily manipulated as used. The bundle of conduits within the fiberglass insulating jacket 514 can be placed within the outer jacket 502 to protect, and further insulate the bundle.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives. For example, while a plural-component structure for use in applying insulation has primarily been described, the features and structures described herein could also be used for mixing more than two components, and for forming items other than insulation. For example, rather than using a spray gun to spray the mixture, a stream or poured mixture could be used for applying the mixture into a form or mold to form a variety of foamed parts.

What is claimed is:

1. A plural-component mixing system, comprising:

a first reservoir containing a first liquid component, the first liquid component being supplied to a first manifold;

a second reservoir containing a second liquid component, the second liquid component being supplied to a second manifold;

a first pressure sensor for monitoring a pressure of the first liquid at the first manifold;

a second pressure sensor for monitoring a pressure of the second liquid at the second manifold;

a first bleed valve associated with the first manifold;

a second bleed valve associated with the second manifold; and a programmable logic controller that receives signals from the pressure sensors and that is programmed to compare the pressure at the first sensor with the pressure at the second sensor and to open the first bleed valve if the pressure at the first sensor exceeds the pressure at the second sensor by a specified amount and to open the second bleed valve if the pressure at the second sensor exceeds the pressure at the first sensor by the specified amount;

a spray gun in fluid communication with the manifolds to spray and mix the liquid components to form a sprayed foam insulation.

2. The plural-component mixing system of claim 1, wherein the programmable logic controller is programmed to open the first bleed valve for a first specified period of time each time the first bleed valve is opened, and wherein the programmable logic controller is programmed to open the second bleed valve for a second specified period of time each time the second bleed valve is opened.

3. The plural-component mixing system of claim 2, wherein a user can modify the specified periods of time using the touch screen interface.

4. The plural-component mixing system of claim 2, wherein the programmable logic controller is programmed to automatically adjust the specified periods of time based on a determined property of the liquid components.

5. The plural-component mixing system of claim 4, wherein the determined property is viscosity.

6. A plural-component mixing system, comprising:

a first reservoir containing a first liquid component;

a second reservoir containing a second liquid component;

a spray gun in fluid communication with the reservoirs to spray and mix the liquid components to form a sprayed foam insulation;

a first flow-rate sensor for sensing a flow rate of the first liquid;

a second flow-rate sensor for sensing a flow rate of the second liquid;

a first bleed valve associated with the first liquid component to divert a portion of the first liquid away from the spray gun when opened;

a second bleed valve associated with the second liquid component to divert a portion of the first liquid away from the spray gun when opened; and a controller adapted to receive signals indicating the flow rate at the first flow-rate sensor and the flow rate at the second flow-rate sensor, the controller further adapted to compare the flow rate at the first flow-rate sensor with the flow rate at the second flow-rate sensor and to cause the first bleed valve or the second bleed valve to open to bring a ratio of the first flow rate to the second flow rate into a desired range without interrupting flow of the liquid components to the spray gun.

7. A plural-component mixing system comprising:

a first reservoir containing a first liquid component;

a second reservoir containing a second liquid component;

a first bleed valve associated with the first liquid component;

a second bleed valve associated with the second liquid component;

a proportioner pump for pressurizing the first and second liquid components, the proportioner pump having a preferred storage configuration; and a programmable logic controller operably connected to control function of the bleed valves and the proportioner pump, the programmable logic controller being programmed to include a park function whereby the programmable logic controller causes the bleed valves to be opened and then causes the proportioner pump to move to and remain in the preferred storage configuration while the bleed valves remain open.

8. The plural-component mixing system of claim 7 further comprising:

a first pressure sensor associated with the first liquid component and providing a signal to the programmable logic controller; and a second pressure sensor associated with the second liquid component and providing a signal to the programmable logic controller; and wherein the programmable logic controller is programmed to maintain the bleed valves open during a park function until the pressure sensors indicate a sufficiently low pressure.

9. The plural-component mixing system of claim 7 further comprising:

a touch screen control associated with the programmable logic controller to initiate the park function.

* * * * *